US005263355A

United States Patent [19]

Malagnoux

[11] Patent Number: 5,263,355

[45] Date of Patent: Nov. 23, 1993

[54] NECKING PLIERS FOR PIPES AND THE LIKE

[75] Inventor: Roger Malagnoux, Domont, France

[73] Assignee: Establissements Pierre Grehal et Cie, Saint Brice sous Foret, France

[21] Appl. No.: 855,433

[22] Filed: Mar. 23, 1992

[30] Foreign Application Priority Data

Mar. 28, 1991 [FR] France ..... 91 03767

[51] Int. Cl.[5] ..... B21D 15/02

[52] U.S. Cl. ..... 72/409; 72/385; 81/342; 81/381

[58] Field of Search ..... 72/409, 410, 385; 81/342, 381, 349

[56] References Cited

U.S. PATENT DOCUMENTS

| | | | |
|---|---|---|---|
| 273,382 | 3/1883 | Packham | 72/409 |
| 354,657 | 12/1886 | Rowe | 72/409 |
| 704,217 | 7/1902 | Sarr | 72/409 |
| 1,066,804 | 7/1913 | Falk | 72/410 |
| 1,809,168 | 6/1931 | Junkers | 72/409 |
| 2,861,491 | 11/1958 | Rozmus | 81/349 |
| 3,028,628 | 4/1962 | Rutherford | 72/313 |

FOREIGN PATENT DOCUMENTS

| | | | |
|---|---|---|---|
| 4239 | 3/1879 | Fed. Rep. of Germany | 72/385 |
| 50444 | 6/1889 | Fed. Rep. of Germany | 72/385 |
| 601234 | 8/1934 | Fed. Rep. of Germany | 72/385 |
| 3234898 | 3/1984 | Fed. Rep. of Germany | 72/409 |
| 3638083 | 5/1988 | Fed. Rep. of Germany | 72/385 |
| 513815 | 2/1921 | France | 72/409 |
| 2398580 | 2/1979 | France | 72/410 |
| 2472 | 5/1962 | Japan | 72/385 |
| 7116 | of 1909 | United Kingdom | 72/385 |

*Primary Examiner*—Daniel C. Crane
*Attorney, Agent, or Firm*—Paul & Paul

[57] ABSTRACT

The necking pliers comprises a first arm having a U-shaped cross section and forming a nose in which is made a notch, with the notch defining blade-forming edges. The first arm is articulated to a second arm via a first pin placed near one end of the nose. The second arm defines a set of ramps for actuating at least one blade articulated on a second pin of the first arm, with the second pin being placed beyond the notch.

15 Claims, 2 Drawing Sheets

NECKING PLIERS FOR PIPES AND THE LIKE

FIELD AND BACKGROUND OF THE INVENTION

The present invention relates to novel necking pliers adapted for shaping the end of a first pipe which has to be engaged within another pipe initially of same diameter as the first pipe.

The shaping operation for narrowing one end of a pipe is an operation which has to be frequently made in situ when assembling pipe elements for transportation and distribution of air or other gases, typically in air conditioning installations.

For an appropriate assembling of two pipe lengths, it is indispensable that the contraction or necking is made over a notable length, for example a length of pipe in the order of 5 cm.

The force to be exerted so as to contract the metal by corrugating it depends on several factors, in particular hardness of the metal, thickness of the metal, and of course the length along which the contraction has to be made. In all cases, the effort to be applied to the metal is large.

OBJECT AND SUMMARY OF THE INVENTION

The invention has more particulary for object to provide hand pliers permitting obtaining contraction of the metal of the pipe by exerting on the handles of the hand pliers a force which is proportionally small as compared to that which is applied by the pliers on the metal of the pipe, i.e. the hand pliers of the invention enable working with a high lever arm ratio, while permitting the contraction to be made over a notable length.

According to the invention, the necking pliers for pipes and similar comprises a first arm having a U-shaped cross section and forming a nose in which is made a notch, with the notch defining blade-forming edges, the first arm being articulated to a second arm via a first pin placed near one end of the nose, the second arm defining a set of ramps for actuating at least one blade articulated on a second pin of the first arm, this second pin being placed beyond the notch.

Various other features of the invention will become more apparent from the following detailed description.

BRIEF DESCRIPTION OF THE DRAWINGS

An embodiment of the invention is shown by way of a non limiting example in the accompanying drawings, wherein.

DISCLOSURE OF THE PREFERRED EMBODIMENT

Figure 1:
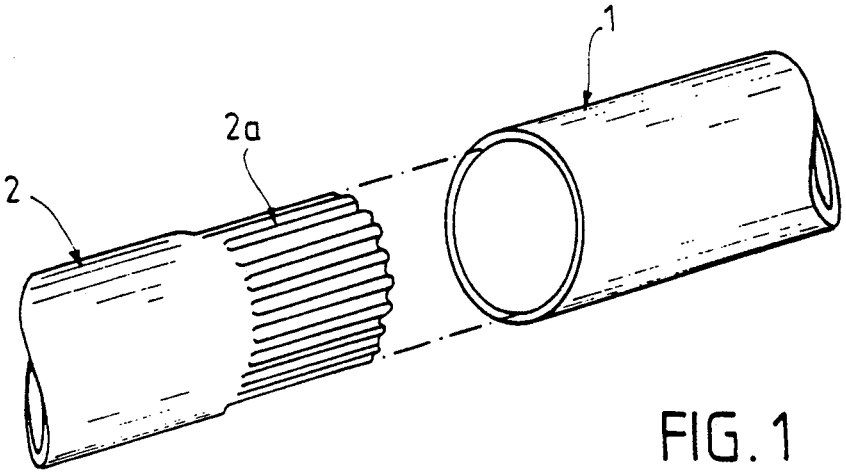
FIG. 1 is a perspective view of two pipe lengths, one of which being corrugatedly necked in order to enable its engagement inside the other pipe length.

Referring now to the drawings, FIG. 1 shows two pipe lengths 1 and 2 which have to be engaged into one another. Originally, the two pipe lengths 1 and 2 are of same diameter and one of them, the pipe length 2, will be contracted or necked at its end 2*a* by formation of corrugations reducing its outer diameter in order to have it coinciding with the inner diameter of the pipe length 1.

In order to form corrugations on the end 2*a*, there is used the pliers shown in FIGS. 2 to 6.

The pliers as shown include two arms 3, 4 formed by U-shaped fittings of different width so that one of the arms can be engaged inside the other by being encased at least at the end thereof where the two arms 3, 4 are articulated about a pin 5.

Figure 6:
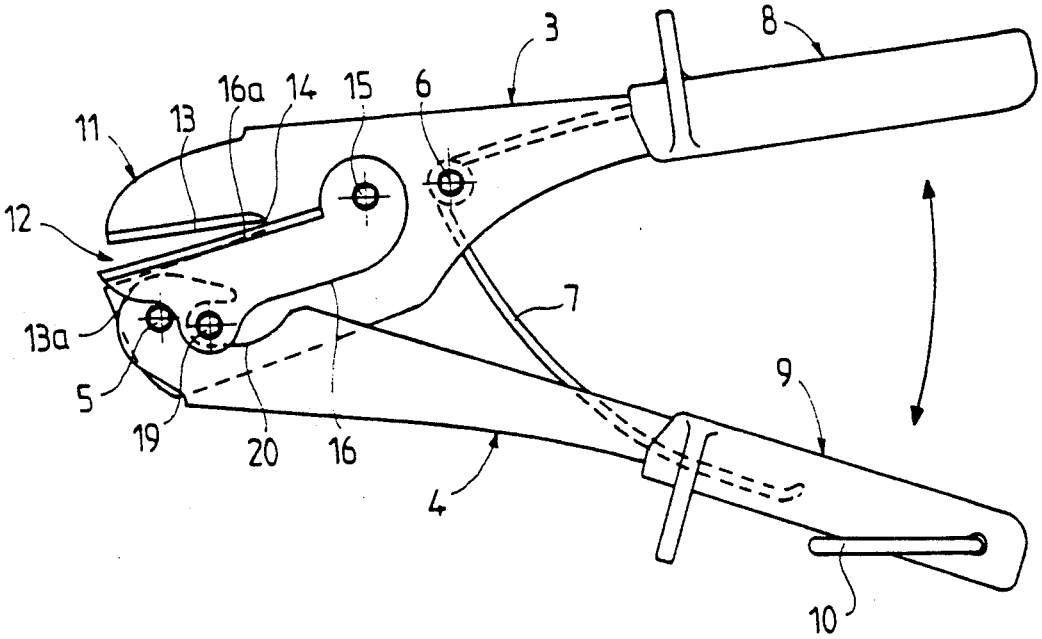
FIG. 6 is a side elevation view similar to FIG. 2 showing the necking pliers in an opened position.

One of the arms, the arm referenced at 3 in the drawings, is provided with a pin 6 for a spring 7 of the hair-pin type and which tends to hold the arms 3, 4 spread apart in the position shown in FIG. 6 by pivoting about the pin 5.

Figure 2:
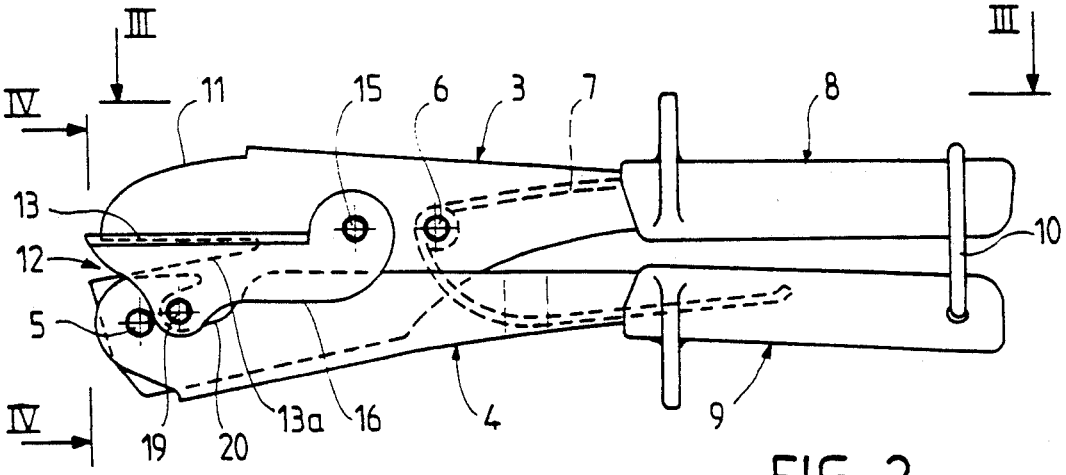
FIG. 2 is a side elevation view of the necking pliers according to the invention.
Figure 3:
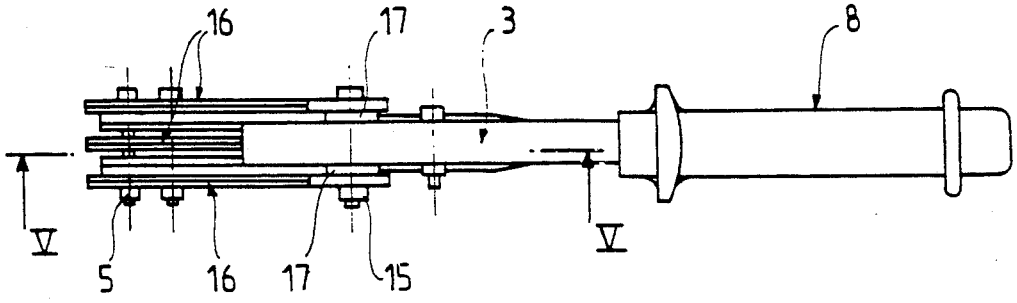
FIG. 3 is a top view as seen from line III—III of FIG. 2.

The arms 3, 4 are shaped as or provided with handles 8, 9, preferably made of a flexible material, and with a clip 10 for keeping the handles 8, 9 together when the pliers are not used, as shown in FIG. 2.

The arm 3 forms, at its front end, in each of its sides 3*a*, 3*b* (see FIG. 4), a nose 11 inside which is formed a notch 12 with edges 13, 13*a* which form substantially a triangle having an apex 14 defining an acute angle. The upper edge 13 of the notch 12 is bevelled so as to define two blades, shown in FIGS. 4 and 6. In practice, the notch 12 has a depth of about 5 cm.

The arm 3 carries, beyond the apex 14 of the notch 12, a pin 15 for an articulation of blades 16 which, in the example shown, are three in number and are conveniently spaced apart from each other by bracing washers 17 carried by the pin 15, and also by bracing washers 18 carried by a pin 19 forming a second connection element for the blades 16.

Figure 4:
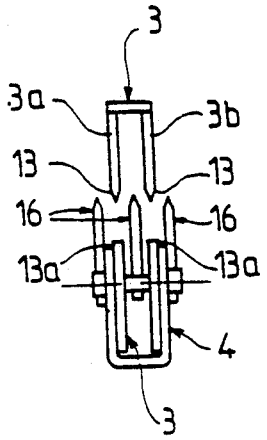
FIG. 4 is an end view as seen from line IV—IV of FIG. 2.
Figure 5:
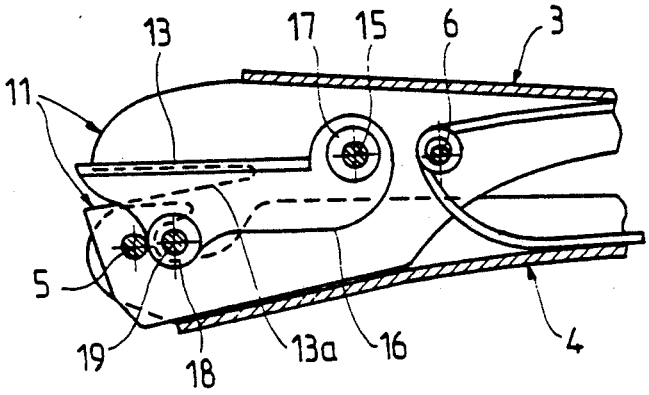
FIG. 5 is a cross sectional view taken along line V—V of FIG. 3.

The thickness of the bracing washers 17 and 18 is selected so that the blades 16 are equidistant to each other, as shown in FIG. 4, and so that the sides 3*a*, 3*b* forming the blades 13 can be interleaved between the blades 16, as also shown in FIG. 4.

The arm 4 defines, opposite the pin 19, a set of ramps 20 in each one of its two sides against which the pin 19 will come to bear since the spring 7 tends to pivot the arm 3 for which the pin 19 is applied against the ramps 20.

The upper edge of the blades 16 is thinned out in order to form counter-blades 16*a* facing the blade-forming edges 13, but which are offset in the manner shown in FIG. 4.

In order to form the corrugations at the end 2*a* of a pipe, the pliers are engaged inside the pipe via their notch 12 while the arms 3, 4 are spread apart as shown in FIG. 6.

When the edge of the pipe reaches the bottom of the notch 12, the handles 8, 9 are pressed and moved toward one another, this movement causing the arms 3, 4 to pivot about the pin 5 against action of the spring 7.

During the above movement, the ramp 20 acts as a cam on the pin 19, so that the blades 16 will pivot about the pin 15, their edges 16*a* being brought near the edge 13 of the sides 3*a*, 3*b* of the arm 3.

The distance separating the pivot pin 5 from the pin 19 controlled by the ramps 20 being short as compared with the length of the arms 3, 4, it is possible to have a very large force exerted by the hereabove described blades 16 and counter-blades 16*a* which deforms the pipe so as to form a set of corrugations.

In the foregoing, the pliers include three counter-blades 16*a*. A simplified embodiment could include only one single counter-blade which would be the medium counter-blade 16 shown in FIG. 4. In that case, only a single corrugation would be formed.

The invention is not restricted to the embodiment shown and described in detail, since various modifications thereof can be carried out thereto without departing from its scope as shown by the accompanying claims.

What is claimed is:

1. Hand operated necking pliers comprising:

(a) a first arm having a U-shaped cross-section and forming a nose at an end thereof in which is made a notch, the side portions of said U-shaped cross-section defining blade-forming edges at the upper portion of said notch;

(b) a second arm having a U-shaped cross-section that encases a portion of said first arm and being rotatably mounted on said first arm by a first pin located near the end of said nose and adjacent to the lower portion of said notch, said second arm including a set of ramps defined on the sides of said U-shaped cross-section;

(c) a blade member rotatably mounted on said first arm by a second pin located beyond said notch at a substantially greater distance from the end of said nose than said first pin; and (d) a third pin fastened to said blade member and slidably retained in relation to said set of ramps of said second arm, wherein rotation of said first arm about said first pin toward said second arm causes said blade member to rotate about said second pin and said third pin to slide along said set of ramps of said second arm to thereby close said blade member in relation to said blade-forming edges of said first arm.

2. The pliers as set forth in claim 1, wherein said blade member comprises a plurality of blades fastened together by said third pin.

3. The pliers as set forth in claim 1, wherein said blade member comprises a plurality of blades fastened together by said second pin.

4. The pliers as set forth in claim 1, wherein said blade member comprises a plurality of blades fastened together by said second and third pins.

5. The pliers as set forth in claim 1, wherein a hair-pin spring is mounted on said first arm and engages said second arm for biasing apart said first and second arms.

6. The pliers as set forth in claim 1, wherein said blade member comprises three blades separated from one another by bracing washers in such a manner that said three blades are offset with respect to said blade-forming edges of said first arm.

7. The pliers as set forth in claim 6, wherein said three blades are fastened together by said third pin and said bracing washers are disposed on said third pin between said blades.

8. The pliers as set forth in claim 6, wherein said three blades are fastened together by said second pin and said bracing washers are disposed on said second pin between said blades.

9. The pliers as set forth in claim 6, wherein said three blades are fastened together by said second and third pins and said bracing washers are disposed on said second and third pins between said blades.

10. The pliers as set forth in claim 1, wherein said ramps are located substantially closer to said first pin than said second pin.

11. The pliers as set forth in claim 1, wherein said first and second arms comprise handles extending from the ends thereof opposite said nose.

12. Hand operated necking pliers comprising:

(a) a first arm having a U-shaped cross-section and forming a nose at an end thereof in which is made a notch, the side portions of said U-shaped cross-section defining blade-forming edges at the upper portion of said notch;

(b) a second arm having a U-shaped cross-section and being rotatably mounted on said first arm by a first pin located near the end of said nose and adjacent to the lower portion of said notch, said second arm including a set of ramps defined on the sides of said U-shaped cross-section;

(c) a blade member rotatably mounted on said first arm by a second pin located beyond said notch at a substantially greater distance from the end of said nose than said first pin, said blade member comprising three blades separated from one another by bracing washers in such a manner that said three blades are offset with respect to said blade-forming edges of said first arm; and (d) a third pin fastened to said blade member and slidable retained in relation to said set of ramps of said second arm, wherein rotation of said first arm about said first pin toward said second arm causes said blade member to rotate about said second pin and said third pin to slide along said set of ramps of said second arm to thereby close said blade member in relation to said blade-forming edges of said first arm.

13. The pliers as set forth in claim 12, wherein said three blades are fastened together by said third pin and said bracing washers are disposed on said third pin between said blades.

14. The pliers as set forth in claim 12, wherein said three blades are fastened together by said second pin and said bracing washers are disposed on said second pin between said blades.

15. The pliers as set forth in claim 12, wherein said three blades are fastened together by said second and third pins and said bracing washers are disposed on said second and third pins between said blades.

* * * * *